United States Patent [19]

Kane et al.

[11] Patent Number: 4,637,153

[45] Date of Patent: Jan. 20, 1987

[54] MULTIPLE CONFIGURATION DISPLAY SIGN SYSTEM

[75] Inventors: Michael Kane, River Forest; Lawrence R. Hogan, Lake Villa, both of Ill.

[73] Assignee: Kane Graphical Corporation, Chicago, Ill.

[21] Appl. No.: 618,955

[22] Filed: Jun. 11, 1984

[51] Int. Cl.[4] ..... G09F 7/00

[52] U.S. Cl. ..... 40/605; 40/506; 40/600; 40/152.1

[58] Field of Search ..... 40/605, 606, 607, 506, 40/600, 572, 152.1; 52/70, 79.5, 79.12; 248/206 A; 211/DIG. 1; 160/229 R

[56] References Cited

U.S. PATENT DOCUMENTS

| | | | |
|---|---|---|---|
| 2,530,525 | 11/1950 | Howenstine | 40/572 |
| 3,015,899 | 1/1962 | Ensign et al. | 40/605 |
| 3,254,438 | 6/1966 | Filary et al. | 40/156 |
| 3,517,451 | 6/1970 | Rychlewski | 40/452 |
| 3,538,976 | 11/1970 | Gilbert et al. | 160/229 R |
| 3,698,111 | 10/1972 | Smith | 40/600 |
| 3,774,332 | 11/1973 | Schneider | 40/152.1 |
| 3,947,987 | 4/1976 | Allen | 40/506 |
| 4,277,903 | 7/1981 | Crossot | 40/152.1 |

FOREIGN PATENT DOCUMENTS

| | | | |
|---|---|---|---|
| 2110404 | 9/1972 | Fed. Rep. of Germany | 40/606 |

*Primary Examiner*—Gene Mancene
*Assistant Examiner*—Cary E. Stone
*Attorney, Agent, or Firm*—Russell E. Hattis; Lawrence J. Bassuk

[57] ABSTRACT

A unique multiple configuration display sign system including a selection of a sign unit supporting and interconnecting hardware and standard sign units of special size, shape and construction as to be capable of use in any one of a multiplicity of display configurations through use of such hardware. The sign unit supporting and interconnecting hardware includes top side and bottom side linking brackets, linking plates or wall hanger brackets for abutting together one or more vertical sides of the sign units to form a selected sign configuration. The sign units supporting and interconnecting hardware integrated within an assembled display configuration to conceal such hardware so that the joined sign units appear to be free standing and unsupported by any visible structure.

26 Claims, 30 Drawing Figures

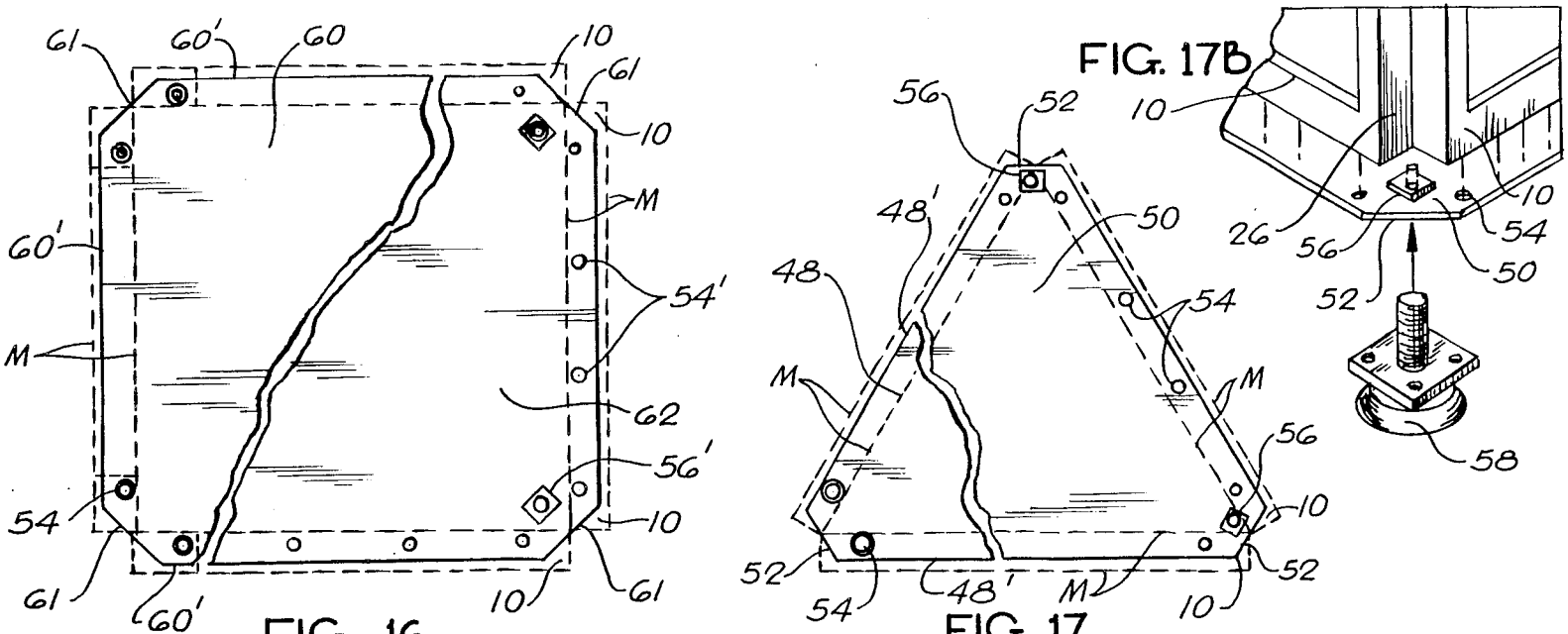
FIG. 17b
FIG. 17
FIG. 16
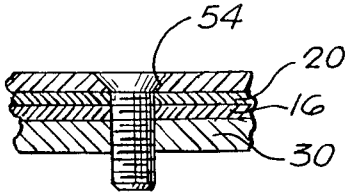
FIG. 17A
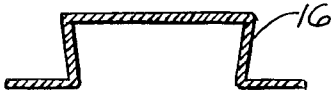
FIG. 19
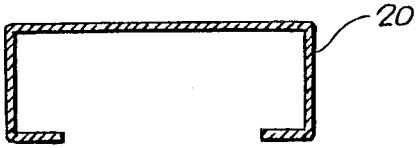
FIG. 18

MULTIPLE CONFIGURATION DISPLAY SIGN SYSTEM

TECHNICAL FIELD

The present invention generally relates to changeable indoor signs for displaying alphanumeric indicia, such as signs used in banks for displaying financial data and investment yields, and in particular, to a flexible system for arranging and interchanging upright sign units of a selected size and shape in a multiplicity of display configurations.

BACKGROUND OF THE INVENTION

For many businesses such as banks and savings and loans, it is often necessary to convey to consumers financial information and data comprised of a combination of alphanumeric indicia, regarding investment offerings, financial yields, rates of return, interest rates, and the like. As a result of such need, changeable display signs with interchangeable and removable sign component pieces bearing alphanumeric indicia have been developed to convey desired information in an attractive presentation and with maximum visual clarity. An example of such changeable display signs is disclosed in my pending U.S. application, Ser. No. 420,044, filed Sept. 20, 1982, entitled "Changeable Display Sign".

One major disadvantage of prior art display sign systems is the limited flexibility of such systems in terms of creating varying display configurations. That is, prior art display signs are assembled so that a single upright sign unit is either free standing or wall-mounted. Because prior art display signs are of various sizes and configurations, it was not heretofore readily possible to assemble such signs in a variety of display configurations without custom mounting and assembly hardware. Hence, prior art display signs were of limited utility to financial institutions.

Another disadvantage of prior art display sign systems is that the assembly hardware often was visible to viewers of the display resulting in an unsightly display presentation.

Hence, prior to the present invention, a need existed for a display sign system utilizing a standard sized and constructed sign unit having at least two display faces, and capable of being interchanged in a multiplicity of display configurations, yet requiring a minimum of assembly and support hardware. Further, the assembly and support hardware should be designed so as to be concealed from view.

SUMMARY OF THE INVENTION

In accordance with the present invention, a multiple configuration display sign system has been developed which includes a selection of sign supporting and interconnecting hardware and standard sign units of such size, shape and construction as to be capable of use in any one of a multiplicity of display configurations through use of such hardware. The preferred standard sign unit of the present invention generally comprises a light-weight, rectangularly-shaped sign unit having a top side, a bottom side, and two vertical sides. In addition, the sign unit is preferably provided with two opposing display faces having a magnetically-attractable surface to carry magnetic, sign component pieces constructed in accordance with the teachings of my aforementioned pending application which is incorporated herein by reference. The unit may be of laminar construction and preferably comprised of cardboard inner core having a honeycomb construction and a steel metal outer lamina adhered on both faces of the cardboard core. Such construction of the sign unit permits the unit to be lightweight and therefore easily handled, yet has sufficient rigidity to be assembled into various display configurations. A sign unit having such a construction was developed by us, and was in commercial use prior to the present invention, which now involves adding fastener-receiving apertures to the sign units and the special sign unit supporting and interconnecting hardware referred to above.

The sign unit supporting and interconnecting hardware may include top side and bottom side linking brackets, linking plates or wall hanger brackets for abutting together one or more vertical sides of the sign units to form a selected sign configuration. The configuration and construction of most of the sign unit supporting and interconnecting hardware is preferably concealed from view in the assembled display configuration.

In one embodiment of the present invention, linking brackets are used to join together the top and bottom sides of the units, about a common vertical axis, to abut only one vertical side edge of each sign unit. In another embodiment, top side and bottom side linking plates join the units by abutting together all vertical side edges of the units, arranging the units in a vertical side-by-vertical side relationship to form a closed geometric configuration. In the aforementioned embodiments of the invention, the linking plates or linking brackets have an edge configuration which coincide with the peripheral configuration of a selected display so that the linking brackets and linking plates are concealed from view. This hardware is best secured to the sign units by bolts or screws passing between the hardware parts and the sign units.

In another form of the present invention, hanger brackets are used to suspend one or more sign units from a wall. Like the linking plates and linking brackets used in assembling the above-described embodiments of the present invention, the hanging brackets are also not visible to viewers of the display signs.

The primary features of the present invention provide a display system having maximum flexibility and employing a standard size sign unit being interchangeable in a variety of display configurations and being easily assembled into such configurations with a minimum of assembly hardware. Further, the hardware is concealed from view in the assembled display configurations. Other advantages of the invention will become apparent upon making reference to the specification and claims to follow.

BRIEF DESCRIPTION OF THE DRAWINGS

FIG. 16 is a composite plan view of the preferred linking plates for the square configuration disclosed in FIGS. 7 and 7A fragmented to disclose in part a top side linking plate and in part a bottom side linking plate;

FIG. 17 is a composite plan view of the preferred linking plates of the triangular configuration embodiment disclosed in FIGS. 6 and 6A fragmented to disclose in part the top side linking plate and in part the bottom side linking plate;

FIG. 17A is a fragmented sectional view through a top linking plate disclosing inside bevelled edges of fastening holes;

FIG. 17B is a fragmented exploded perspective view disclosing the preferred floor glide and the positioning thereof on an underside of a bottom linking plate;

FIG. 18 is a sectional view of the trim channel member comprising a portion of the structure of the preferred sign unit;

FIG. 19 is a sectional view of a hat channel member comprising a portion of the preferred sign unit;

DETAILED DESCRIPTION OF PREFERRED EMBODIMENTS

Figure 1:
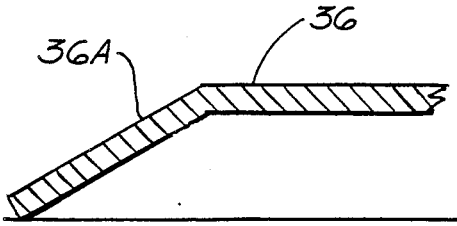
FIG. 1 is a fragmentary vertical section through a single preferred standard sign unit as mounted to an exemplary base plate.
Figure 1:
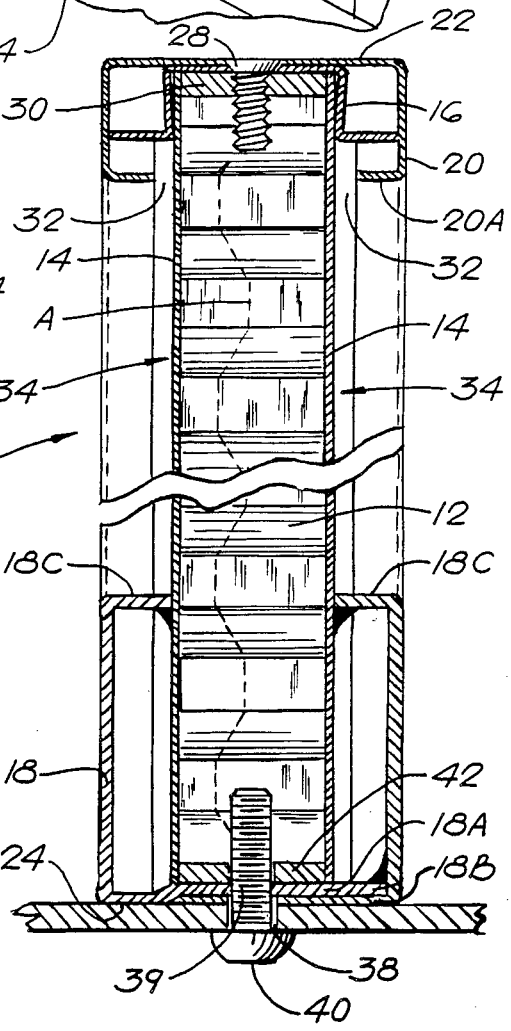

Referring now to the drawings, FIG. 1 discloses the laminar construction of the preferred standard display sign unit 10 used in all display configurations of the system of the present invention. Sign unit 10 is comprised of an interior core 12 preferably made of cardboard and having a honeycomb construction as indicated by topographic reference line A of FIG. 1. The cardboard honeycomb construction of core 12 is lightweight and prevents warping so that sign unit 10 can be easily handled for assembly into various display configurations, and yet provide sufficient structural rigidity to the sign unit 10. Adhesively bonded to each face of core 12 and coextensive with the length thereof are magnetically attractable sheet metal layers 14, preferably made of cold rolled steel panels about 0.035 inches thick. Cold rolled steel is preferred as it does not add substantially to the overall weight of sign unit 10, while imparting adequate strength, rigidity and magnetic attraction properties. Sheet metal layers 14 function as sign component-receiving surfaces which will contain sign-forming indicia to be described in detail later herein. The sheet metal layer 14 provide a magnet attractive backing for sign-component pieces that carry either alphanumeric indicia or supply background spaces and have a magnet-forming backing layer thereon. Sheet metal layers 14 abut at their upper ends against a hat channel member 16 disclosed in isolated view in FIG. 19. Hat channel member 16 preferably is made of cold rolled steel having a preferred thickness of about 0.035 inches. Hat channel member 16 caps and frames top and vertical side portions of core 12 and sheet metal layers 14, while a lower portion of core 12 and sheet metal layers 14 are capped and framed by a bottom channel 18. Bottom channel 18 preferably is also made of cold rolled steel having a thickness of 0.062 inches. Except for the lower portion of sheet metal covered core 14 inserted with bottom channel 18, a trim channel 20, shown in isolated view in FIG. 18, covers the hat channel members 16 which cap all other sides of the sheet metal covered core 14. Trim channel 20 preferably is also made of cold rolled steel having a 0.035 inch thickness same as hat channel member 16. Trim channel 20 is spot-welded to hat channel 16 to define a top side margin 22 of sign unit 10. Bottom channel 18 is welded to trim channel 20 and surrounds the lower portion of the sheet metal covered core 14 by end-over-end folding and spot-welding of the free bottom channel ends 18A and 18B as disclosed in FIG. 1. Thus, bottom channel 18 and particularly ends 18A and 18B defines a bottom margin side 24 of sign unit 10. Hence, core 12 covered by sheet metal layers 14 is tightly framed on top and vertical side portions by the combined structure of trim channel 20 and hat channel member 16 and on lower portions by bottom channel 18.

Figures 5, 5A, 6, 6A, 7, 7A, 8, 8A, 9, 9A, 10, 11:
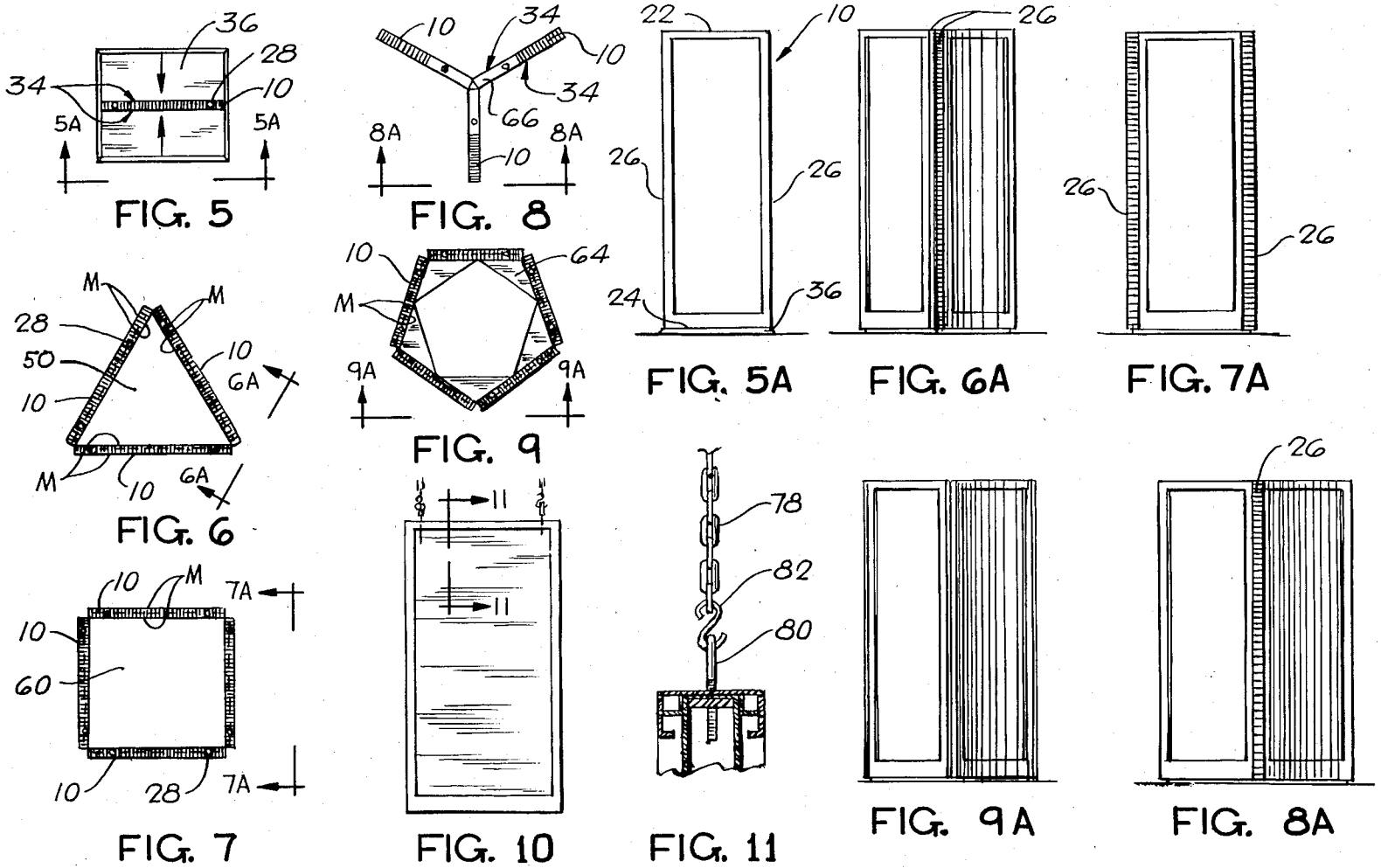
FIG. 5 is a plan view of the single standard sign unit embodiment of FIG. 2.
FIG. 5A is a side elevational view taken along line 5A—5A of FIG. 5.
FIG. 6 is a plan view of a triangular display unit configuration embodiment of the present invention which uses three standard sign units.
FIG. 6A is a side elevational view taken along line 6A—6A of FIG. 6.
FIG. 7 is a plan view of a square display configuration embodiment of the present invention which uses four standard sign units.
FIG. 7A is a side elevational view of the square display configuration taken along line 7A—7A of FIG. 7.
FIG. 8 is a plan view of a three-legged or star display configuration embodiment of the present invention which uses three standard sign units.
FIG. 8A is a side elevational view of the star display configuration taken along line 8A—8A of FIG. 8.
FIG. 9 is a plan view of a pentagonal display configuration embodiment of the present invention using five standard sign units.
FIG. 9A is a side elevational view of the pentagonal configuration taken along line 9A—9A of FIG. 9.
FIG. 10 is a side elevational view of a ceiling or beam single sign unit suspended embodiment of the present invention.
FIG. 11 is a fragmented vertical section taken along line 11—11 of FIG. 10.

As disclosed in FIG. 5A, sign unit 10 is preferrably generally rectangular and includes four margins defining two longer vertical sides 26 in addition to top side margin 22 and bottom side margin 24. Top side 22 is provided with a plurality of holes 28, preferably at least two, one of holes 28 being shown in section in FIG. 1. Holes 28 are aligned with coinciding holes on the sign unit interconnecting hardware for display configurations requiring more than one sign unit. The holes 28 are threaded by means, preferably of weld nuts 30, welded to the underside surface of hat channel 16. Threaded holes 28 receive corresponding threaded fasteners joining the top sides 22 of sign units 10 to the assembly hardware.

Trim channel 20 has inturned portions 20A (FIG. 1) directed toward and spaced from the sheet metal covered core 12 to define gaps 32 therebetween. The gaps 32 at the top of the sign unit 10 receive top portions of wall hanger brackets used in various sign-suspended embodiments of the present invention to be described later, and covers the edges of layers 44A and 44B of sign component pieces 44 (See FIG. 2), to accommodate discrepancies. Two display faces 34 of sign unit 10 are defined between the inwardly turned portions 20A of trim channel 20 and inwardly turned portion 18C of bottom channel 18. In some embodiments of the present invention, both display faces 34 of sign unit 10 are visible to viewers of the overall display configuration, while in other embodiments of the present invention only one display face 34 of each sign unit 10 can be seen by a viewer.

A single sign unit 10 can be floor mounted in an upright position through use of a base plate 36 having a flanged front portion 36A and a flanged rear portion (not shown) angled 30° downward from base plate 36. Bottom side 24 of sign unit 10 is mounted to base plate 36 through base plate holes 38 which receive threaded fasteners 40, preferably button head screws. Fasteners 40 pass through base plate holes 38 and corresponding bottom side holes 39 on the bottom side 24, each sign unit 10 preferably having four, and engaged with threaded weld nuts 42 welded to the inside bottom of bottom channel 18.

Figure 2:
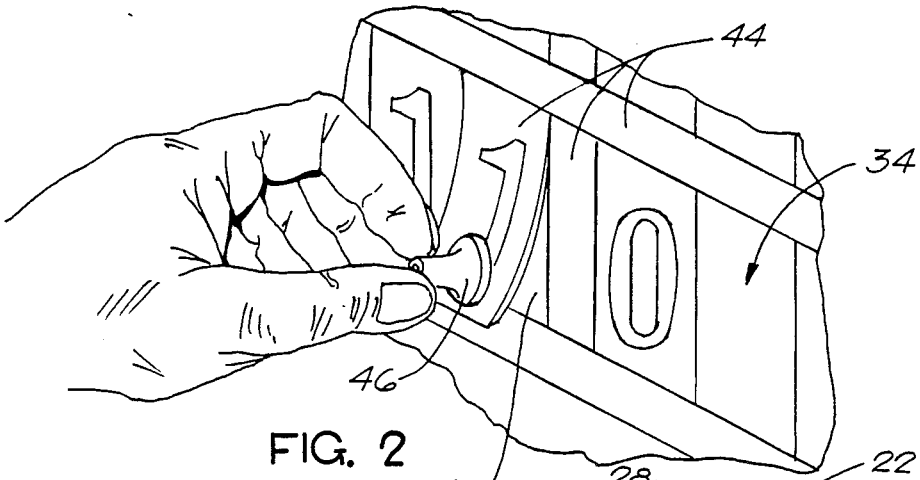
FIG. 2 is a detailed perspective view of the preferred flexible sign component pieces and sign component piece handling tool which may be utilized in the present invention.
Figure 4:
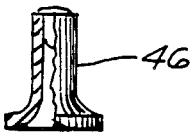
FIG. 4 is a side elevational view of a partial vertical section of the sign component piece handling tool disclosed in FIG. 1.

FIG. 2 discloses a flexible sign component piece 44 positioned on display faces 34 of sign unit 10. A user can remove any selected sign component piece 44 through use of a handling tool 46. As disclosed in FIG. 4, the tool 46 is a bell shaped suction cup.

Figure 3:
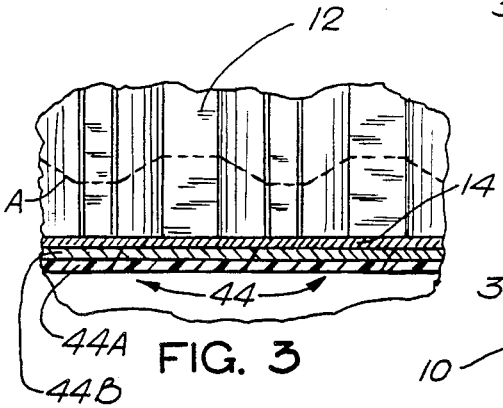
FIG. 3 is an enlarged fragmented sectional view taken from FIG. 2, disclosing construction of sign component pieces magnetically secured to the sign unit.

The general construction of sign component pieces 44 is disclosed in FIG. 3. However a more detailed disclosure of such composition and structure is available in my aforementioned pending U.S. patent application, Ser. No. 420,044, which is incorporated herein by reference. Each sign component piece 44 includes at least a cover layer 44A, which in some cases has visible indicia thereon, and a magnet-forming back layer 44B. The pieces preferably are thin and flexible. Adjacent sides of the pieces have complementary interfitting, bevelled edges. The sign component pieces 44 can be smaller pieces forming individual alphabetic or numeric characters or blank spaces, or longer blank or information containing spaces.

FIG. 5 discloses a simple embodiment of the present display configuration system utilizing a single upright sign unit 10 perpendicularly mounted to base plate 36 as disclosed in FIG. 1. The single sign unit embodiment disclosed in FIGS. 5 and 5A makes available for use two display faces 34.

FIGS. 6, 6A, 7, 7A, 8, 8A, 9 and 9A disclose preferred multi-sign unit embodiments of the display sign system of the present invention. FIGS. 6 and 6A disclose a triangular configuration comprised of three sign units FIGS. 7 and 7A disclose a square configuration comprised of four sign units and FIGS. 9 and 9A disclose a pentagonal configuration comprised of five sign units. In the triangle, square and pentagonal configurations, the number of available display faces 34 is equal to the number of sign units 10 used in assembling the configuration while the Y-shape configuration of FIG. 8 has six display faces 34 using three sign units.

The triangular configuration of FIGS. 6 and 6A is assembled by abutting together all vertical sides 26 and in particular the vertical side edges of the three units 10. Such an assembly is achieved through use of a substantially triangular top linking plate 48 (See FIG. 17), joining the top sides 22 of sign units 10. Further, the bottom sides 24 of sign units 10 are joined together through use of a substantially triangular bottom side linking plate 50. As best disclosed in FIG. 17, the corners of top side linking plate 48 and bottom linking plate 50 are removed to provide straight edges 52 which intersect the vertical lines of intersection of the abutting edges of the asserted sign units 10 shown in phantom in FIG. 17. Further, the peripheral edges 48' of such as plate 48 are aligned with the margins M of the top surfaces 22, and the peripheral edges 50' of plate 40 are likewise aligned with the bottom surfaces 24. Thus, when sign units 10 are positioned in abutment and secured between plates 48 and 50, such plates are not visible to viewers of the overall display configuration, as seen in both FIGS. 6 and 17. In order to further enhance concealment of top linking plate 48 all peripheral edges 48' of top plate 48 are bevelled to remove all sharp, cornered edges which may be visible to viewers.

In addition, plates 48 and 50 are provided with holes 54 for receiving threaded fasteners such as screws interconnecting mounting plate 48 to the top sides 22 of sign units 10 and plate 50 to the bottom side 24 of sign units 10. There are four such holes 54 along each side of bottom plate 50 corresponding to the four bottom side sign units holes 39 and two such holes 54 along each side of top plate 48 corresponding to the other two top side sign units holes 28. Preferably, the inside edges of holes 54 are also bevelled inward so that a head of a threaded fastener becomes countersunk and concealed from view, as shown in FIG. 17A. Bottom side linking plate 50 is provided with additional holes 54 since bottom plate 50 functions to support as well as arrange sign units 10 in a triangular configuration and requires more securing parts. On the other hand, top linking plate 48 primarily functions to maintain the sign unit in parallel alignment and to assure abutment of all vertical sides 26 of each of units 10. In this regard, bottom plate 50 is thicker, preferably about 0.135 inches while top plate 48 is about 0.061 inches thick. Both plates 48 and 50 are made from cold rolled steel. Also, bottom side linking plate 50 includes a threaded receiving means 56, preferably weld nuts, for carrying floor glides 58 shown in FIG. 17B on an underside of bottom plate of 52. The floor glides 58 stabilize, balance and level the overall display sign configuration.

The four units comprising the square configuration of FIGS. 7 and 7A are assembled through use of hardware similar to that for the triangular configuration disclosed in FIGS. 6 and 6A. Top sides 22 of sign units 10 are joined through use of a square top linking plate 60 and bottom sides 24 of sign unit 10 are joined through use of a square bottom linking plate 62. As in plates 48 and 50 for the triangular configuration described above, top linking plate 60 and bottom linking plate 62 are cornerless, i.e. have straight edges 61 which intersect the vertical lines of intersection formed by abutting vertical edges of vertical sides 26 of the sign units 10. Also, the peripheral edges thereof are aligned with the margins M. Thus, when sign units 10 are assembled between plates 60 and 62, as shown in phantom in FIG. 16, linking plates 60 and 62 are concealed from view. Further, at least edges 60' of top linking plate 60 are bevelled to further conceal plate 60 from view. As with bottom plate 50, used in assembly of the triangular configuration, bottom plate 62 further includes fastening holes 54' and threaded receiving means 56' preferably weld nuts.

Figure 20:
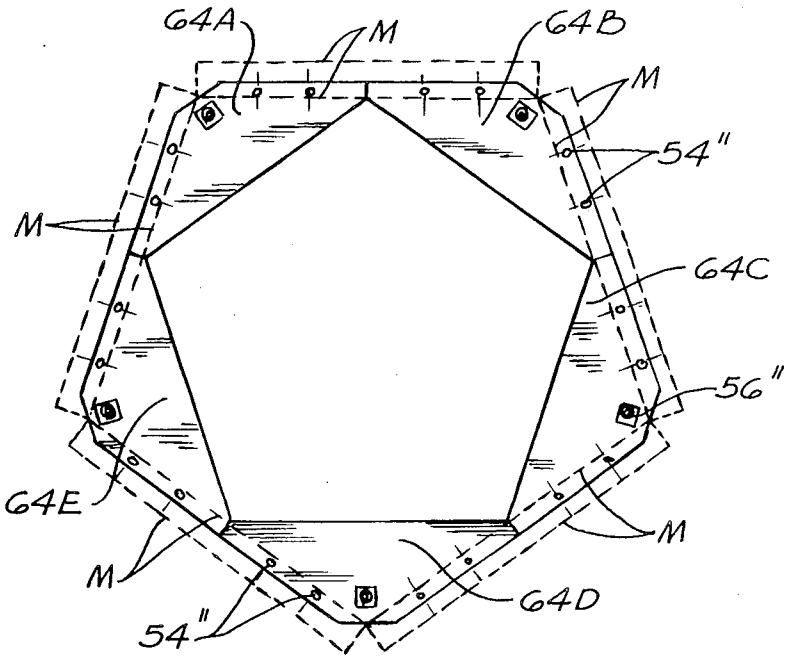
FIG. 20 is a plan view of the preferred bottom side linking plates for the pentagonal configuration disclosed in FIGS. 9 and 9A.

Although plates 48 and 50 of the triangular configuration and linking plates 60 and 62 of the square configuration are solid plates having a peripheral edge configuration substantially coinciding with the edge of the sign units, another feature of the present invention conceives of the use of a plurality of top linking plates and bottom linking plates such as disclosed in the pentagonal configuration of FIGS. 9 and 20. Because the linking plates of the present invention are made from cold rolled steel, in larger display configurations, utilizing more than four units, the surface area of the linking plates can become quite large and therefore burdensome in shipping and assembling the display system. Hence, as exemplified in FIGS. 9 and 20, bottom linking plate 64 for the pentagonal configuration is comprised of a plurality of separate plates 64A–64E which join portions of the bottom side of adjacent units at each apex of the pentagonal configuration. Hence, each bottom side 24 of each sign unit 10, shown in phantom in FIG. 20, is joined to the overall display configuration by two bottom linking plates 64. Further, each sign unit 10 bridges together each linking plate 64 eliminating the need of having to link each bottom linking plate 64A with another bottom linking plate.

Although it is contemplated that larger display configurations utilizing more sign units would use a plurality of bottom linking plates and a plurality of top linking plates in order to avoid the enlarged surface area encountered with single linking plates, it is within the scope of the present invention that any closed geometric display configuration that utilizes top and bottom linking plates may be comprised of a plurality of individual plates as exemplified in the pentagonal configuration in order to facilitate knock-down and assembly of various display configurations. Further, another important feature of the closed geometric display configurations disclosed in FIGS. 6–9 is that the assembly hardware, i.e. top linking plates and bottom linking plates are concealed from view as a result of the unique manner in which sign units 10 are employed in each configuration and as a result of the cornerless edge configurations of the linking plates.

Another preferred embodiment of the display sign configuration of the present invention is disclosed in FIGS. 8 and 8A. In this embodiment one vertical side 28 of each of three sign units 10 are abutted together about a common vertical axis to form a Y-shaped or "star" display configuration. Unlike the closed geometric display configurations disclosed in FIGS. 6–9, the "open", Y-shaped configuration disclosed in FIG. 8 has a characteristic of having each display face 34 of each of the three sign units 10 used in configuration available for use in displaying alphanumeric indicia. A further distinguishing feature of the FIG. 8 embodiment from the prior embodiment disclosed in the these figures is the use of linking brackets which assume the peripheral edge configuration of the top sides 22 and bottom sides 24 of sign units 10.

Figure 23:
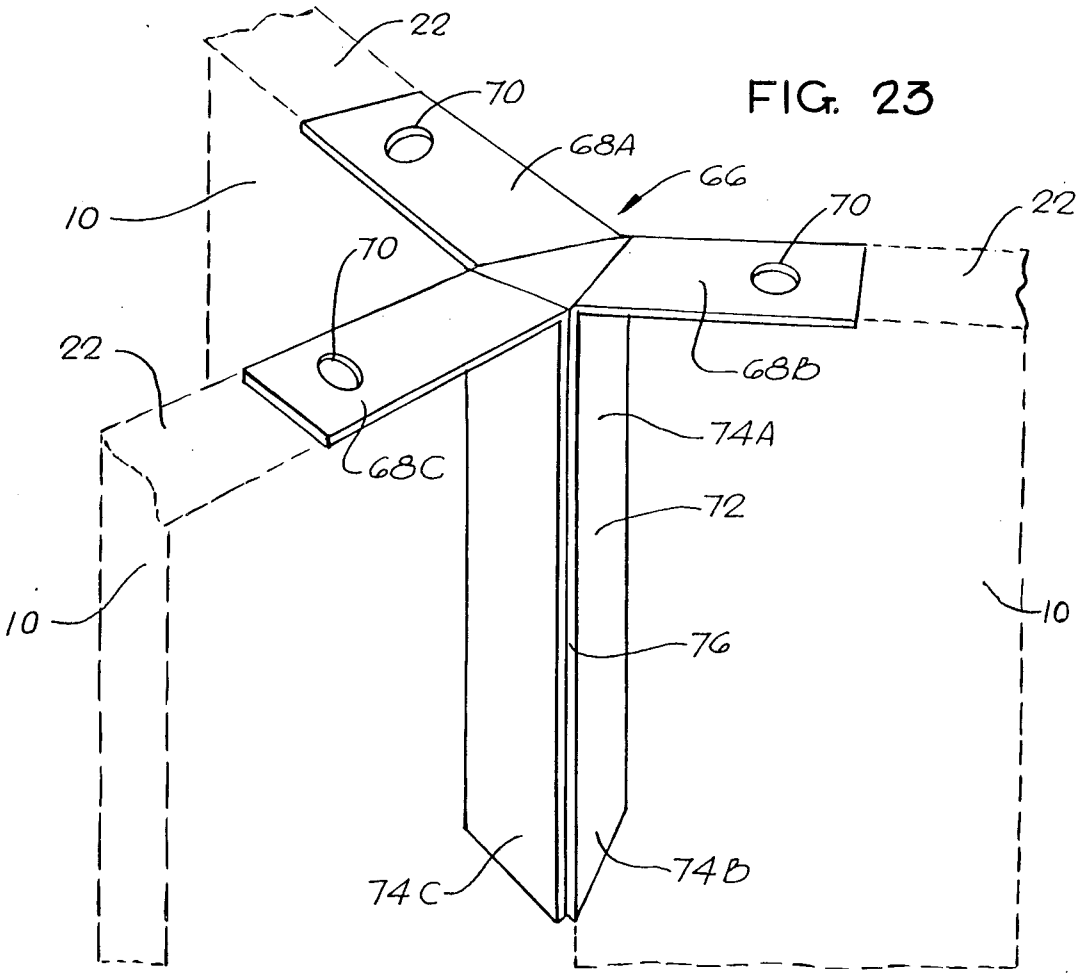

FIG. 8 discloses top linking bracket 66 fastened to the top sides 22 through alignment with holes 28 on top sides 22 of sign units 10. FIG. 23 best discloses the structural features of top linking bracket 66. As explained for the linking plates utilized in the embodiment disclosed in FIGS. 6, 7 and 9, a novel feature of the invention is that the assembly hardware has a peripheral configuration which substantially coincides with the peripheral edge or margin configuration of a given display. This feature is also embodied in the sign unit assembly and interconnecting hardware utilized in the embodiment of FIG. 8. In the FIG. 8 embodiment, top linking bracket 66 is comprised of three legs 68A, 68B and 68C which are shown in FIG. 23. Legs 68A–68C are no wider than top sides 22 of sign units 10 and preferably extend no more than about one-quarter of the length of top sides 22. It has been determined that such length of legs 68A–68C provide adequate support and resistence to relative torsional movement among sign units 10. Top linking bracket 66 is mounted to top sides 22 of sign units 10 through holes 70 which align with the first of holes 30 on top sides 22 as previously discussed. Securing top linking bracket to only one of top side holes 28 has been found adequate to maintaining alignment and abutment of sign units 10. Aligned holes 70 and 28 may receive a threaded fastener such as a button head screw or any other fastener known in the art. As in the embodiment of FIGS. 6, 7 and 9, an additional method of concealing the assembly hardware in the embodiment of FIG. 8 is to inwardly bevel the side of holes 70 so that the head of any threaded fastener may be countersunk below the surface of legs 68A–68C thereby concealing the fastening means.

In assembling the configuration of FIG. 8 wherein only one vertical side of each of sign units 10 is abutted together about a common vertical axis, a triangular channel is formed between the abutted vertical sides 26 of the sign units. It has been ascertained that "open" display configurations such as disclosed in FIG. 8 are subject to relative torsional movement among sign units 10. Thus, it has been found necessary that a stabilizing shaft 72 of linking bracket 66, normally disposed to legs 68A–68C be seated within the aforementioned triangular channel in order to eliminate such torsional movement. As disclosed in FIG. 23, each of legs 68A–68C of top linking bracket 66 are smaller portion of corresponding larger L-shaped piece in which a longer legs 74A, 74B and 74C are spot-welded along abutting peripheral edges 76 to form shaft 72. Though it has been found necessary that the top linking bracket 66 be provided with a stabilizing shaft 72, such a shaft normally is not provided for a bottom linking bracket (not shown) through the use of a stabilized shaft is within the scope of the present invention. The bottom linking bracket which assumes essentially the same overall structure and configuration as top linking bracket 66, with the exception that the legs of Y-shaped bottom linking bracket are longer than the legs of top bracket 66. The legs of the bottom bracket have two holes for fastening and alignment with two of the four holes 39 along bottom side 24 since bottom linking bracket provides primary support and interconnection among the three sign units 10 of the FIG. 8 embodiment.

The display configuration disclosed in FIG. 8 is particularly useful since as previously mentioned, it permits usage of each display face 34 of each sign unit 10. However, it should be emphasized that as in the closed geometric display configurations of FIGS. 6–9, the assembly hardware, i.e. top linking bracket 66 and a bottom-side linking bracket have a configuration so as to be invisible to a viewer of the display. In other words, it will appear to a viewer that the units of the display configuration have no visible means for support but are free-standing.

FIGS. 10 and 11 disclose the usefulness of sign units 10. Sign units 10 are readily adaptable to a known means of ceiling suspension or suspension from a support beam by means of a length of suspension cable 78, preferably link chain, an eye screw 80, and a coupling hook 82 between suspension chain 78 and eye screw 80.

Figure 13:
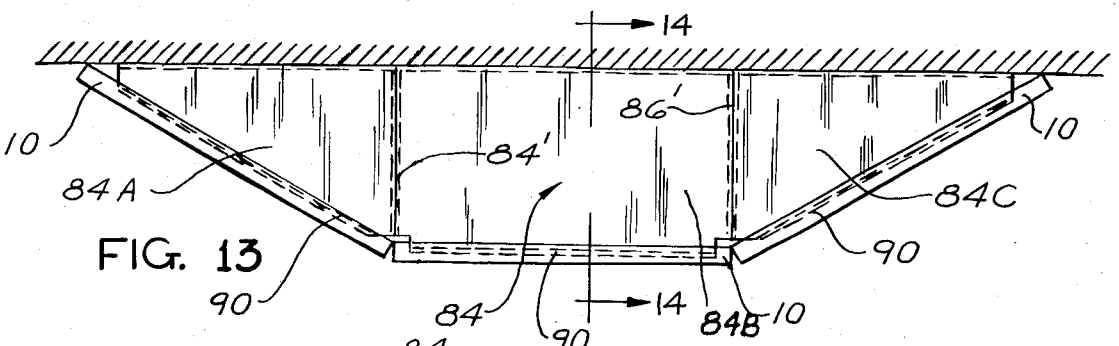
FIG. 13 is a plan view of the embodiment disclosed in FIG. 12.
Figure 12:
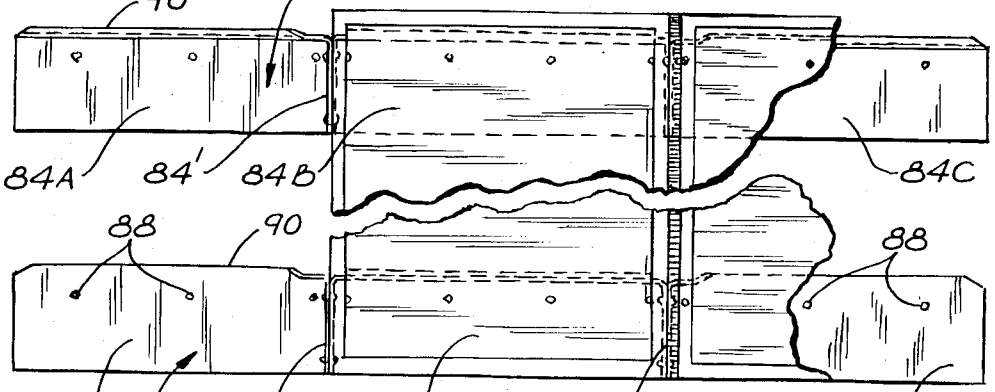
FIG. 12 is a fragmented front view of a three sign unit display configuration suspended from wall angle brackets.

FIG. 12 discloses another preferred embodiment of the display sign configuration system of the present invention wherein as in the embodiment of FIG. 8 and closed geometric configuration embodiments of FIGS. 6–9, the mounting and assembly hardware are concealed from view so that the overall display sign configuration appears supported by no visible means. In the embodiment of FIG. 12, three sign units are relatively disposed at a selected angle to form what has commonly been referred to as a "bay window" configuration as disclosed in FIG. 13. An upper portion of each sign unit 10 is hung or suspended from a top wall hanger bracket 84A, 84B and 84C for each of the three units 10 and a lower wall hanger bracket 86A, 86B and 86C for lower portions of sign units 10. Each of wall hanger brackets 84 and 86 are wall mounted through fastening holes 88 by use of toggle bolts, anchor screws or other known means.

Figure 15:
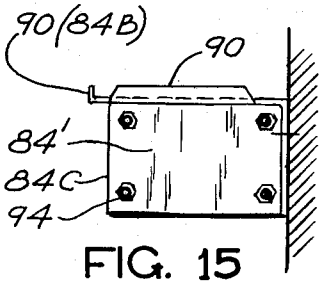
FIG. 15 is a side elevational view of a wall bracket for the embodiment disclosed in FIG. 12 from which a sign panel has been removed.
Figure 14:
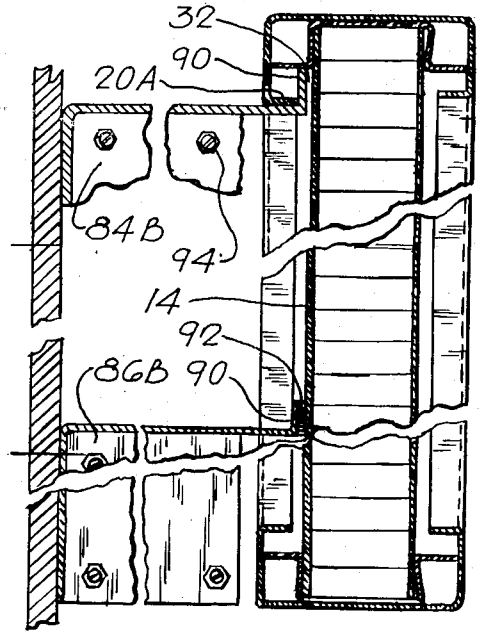
FIG. 14 is a fragmented vertical section viewed along line 14—14 of FIG. 13.

As disclosed in FIGS. 14 and 15, upper portion wall hanger brackets 84 and lower portion wall hanger brackets 86 are provided with upwardly turned engaging flanges 90. FIG. 15 provides a side view of an end bracket, such as 84C, disclosing the positioning of flanges 90 of bracket 84C relative to flange 90 of adjacent bracket 84B. Each flange 90 of upper brackets 84 seat within gaps 32 of sign units 10 so that a portion of the top surface of bracket 84 contacts the inward turned portion 20A of trim channel 20. Through this arrangement, the upper portion of sign units 10 are suspended from upper brackets 84A–84C. It has been determined that in the "bay window" configuration disclosed in FIGS. 12 and 13, the weight of sign units 10 are carried by upper wall hanger brackets 84. Hence, lower wall hanger brackets 86 function merely to restrain pendulum-like swinging of the lower portions of sign units 10. To facilitate restraint of such unwanted movement, ferromagnetic strips 92 are adhesively bonded to the outside surface of flanges 90 of lower brackets 86. Magnetic strips 92, thereby attractably secure flanges 90 of lower brackets 86 to sheet metal layers 14 on core 12. Such supporting and interconnecting hardware for the "bay window" configuration is in accord with one feature of the present invention. That is, the hardware permits assembly of the display configuration without modification of the sign units thereby permitting ready use of the units in the other display configurations herein described.

Each of upper hanger brackets 84A, 84B and 84C and lower brackets 86A, 86B and 86C, are linked to form a unitized hanger assembly by abutting and fastening together, with threaded bolts and nuts 94, common alignment walls 84' and 86'.

Figure 21:
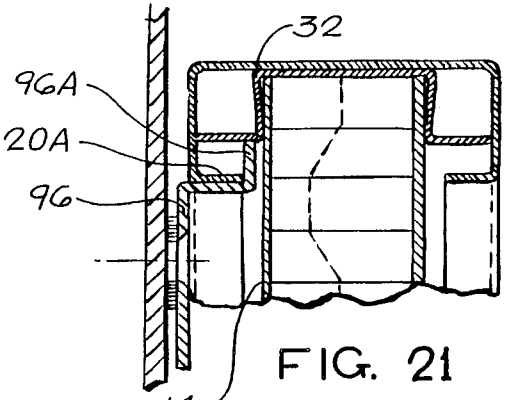
FIG. 21 is a fragmented vertical sectional view of a single unit suspended from a wall hanger bracket.
Figure 22:
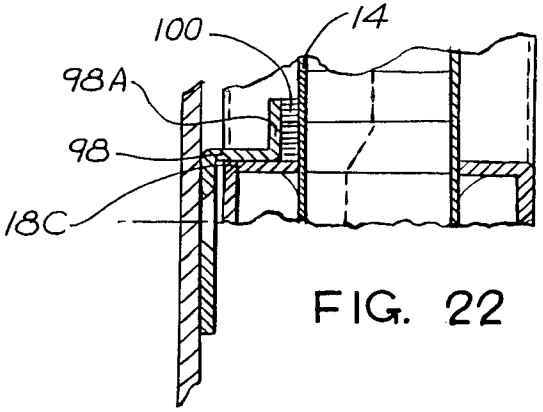
FIG. 22 is a fragmented vertical sectional view of the embodiment of FIG. 21 disclosing a magnetically-adhered wall mounted retention bracket; and, FIG. 23 is a perspective view of the preferred top side linking bracket for the star display configuration disclosed in FIGS. 8 and 8A.

FIGS. 21 and 22 disclose an embodiment similar to the "bay window" display configuration disclosed in FIGS. 12–15 and having similar assembly hardware. Upper portions of unit 10 are suspended from an upper wall bracket 96 having an upwardly turned flange 96A which seat within gaps 32 of sign units 10 so that the top surface of bracket 96 contacts portion 20A of trim channel 20. As explained in the "bay window" configuration, the weight of sign unit 10 is carried by the upper bracket 96 so that a lower wall hanger bracket 98 is required simply to restrain pendulum swinging of the lower portions of sign units 10. Such movement is restrained by ferromagnetic strips 100 adhesively bonded to an outside face of an upwardly turned flange 98A of bracket 98. Strips 100 attachably secure brackets 98 to sheet metal layers 14. FIG. 22 discloses a positioning of lower bracket 98 different from the positioning disclosed for lower bracket 86 in FIG. 14. in FIG. 22, a flat underside surface of bracket 98 contacts portion 18A of bottom channel 18. A primary distinction between the embodiment of FIGS. 12–15 and the embodiment of FIGS. 21 and 22 is that the assembly hardware of the former projects the sign units from the wall whereas the hardware of the latter maintains the sign units essentially flush against the wall. As in the prior embodiments of the present invention, the single wall suspended embodiment disclosed in FIGS. 21 and 22 is assembled so that the assembly hardware, namely upper bracket 96 and lower hanger bracket 98 are not visible to viewers of the display configuration. Hence, a single sign unit 10 mounted in accordance with the embodiment of disclosed in FIGS. 21 and 22 appears to be suspended from a wall without any visible means of support.

Each of the unique display configurations described, namely the closed geometric configuration embodiment disclosed FIGS. 6–9, the open configuration embodiment exemplified by the star configuration disclosed in FIG. 8, the plurality of wall hung units embodiment exemplied by a "bay window" configuration disclosed in FIGS. 12–15 and the unitary wall hung unit disclosed in FIGS. 21–22 have a unique feature of being assembled and arranged with the assembly hardware which is not visible to viewers of the overall display configuration. To a viewer of such display sign configurations, the sign units comprising the configuration do not have any visible assembly or support hardware. Hence, the units in the above-listed embpodiments appear to be free standing. This has the distinct advantage of eliminating any visual distractions from the information carried on the display faces of each unit as well as providing for an attractive presentation of such information.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out the invention, but that the invention will include all embodiments falling within the scope of the appended claims.

I claim:

1. A mutliple configuration display sign system comprising:

at least five upright sign units, each unit having at least two display faces, a top side, a bottom side and two opposite vertical sides;

top side linking means for linking the top sides of the units; and bottom side linking means for linking the bottom sides of the units; the top side linking means and the bottom side linking means in combination joining the units by abutting together their vertical sides to arrange the units in vertical side-by-vertical side relationship and thereby forming a closed substantially pentagonal configuration wherein only one display face of each unit is presented for display of alpha-numeric indicia and wherein the top side linking means and the bottom side linking means include a plurality of generally triangular plates, each plate having a peripheral edge configuration so that when the plates are abutted together the peripheral edges form a substantially pentagonal configuration.

2. The multiple configuration display sign system of claim 1 wherein the top side linking plates and the bottom side linking plates are cornerless and forming straight edges, one straight edge of each plate intersecting a vertical line of intersection formed by the abutment of the vertical side edges of the sign units.

3. A multiple configuration display sign system comprising:

a plurality of upright sign units for assembling a selected display configuration, each unit having at least two display faces, a top side, a bottom side and two vertical sides;

a plurality of plates for linking the top sides of each unit, the plates having a peripheral edge configuration so that when the plates are abutted together the peripheral edges form the selected display configuration;

a plurality of plates for linking the bottom sides of each unit, the plates having a peripheral edge configuration so that when the plates are abutted together the peripheral edges form the selected display configuration;

the top side linking plates and the bottom side linking plates in combination joining the units by abutting together their vertical side edges to arrange the units in a vertical side-by-vertical side relationship corresponding to the selected display configuration.

4. A display sign system for displaying carried indicia, the system comprising: at least three sign units arranged in a closed configuration, each sign unit having a pair of opposite vertical faces at least one of which receives said indicia and margins defined by a pair of vertical side marginal portions, a top marginal portion and a bottom marginal portion, both vertical sign marginal portions of each sign unit confronting the side marginal portion of another sign unit, each sign unit further including threaded hole means at said top marginal portion for holding the received shaft of a fastener engaged therein from the exterior of said sign unit; and top bracket means for joining adjacent sign units at their top marginal portions, the top bracket means including plate means with hole means therethrough spaced from one another certain distances to be aligned with said threaded hole means of said sign units when said sign units are vertically arranged with their side marginal portions in contiguous relation, said plate means having a marginal configuration conforming to the outer profile of said sign units, and fasteners having shafts that are passed through said aligned plate hole means and threaded hole means of said sign units.

5. The display sign system of claim 4 wherein said plate means extend along the top surfaces of said sign units, and said fasteners have heads substantially flush with the outer surfaces of said plate means.

6. The display sign system of claim 5 in which said plate means have faces engaging said top surfaces in said sign units and peripheral edges at or within the margins of the horizontal profile of said sign units.

7. The display system of claim 4 in which there are four sign units arranged in closed configuration and said plate means has a square marginal configuration.

8. The display sign system of claim 4 in which there are five sign units and said plate means has a pentagonal marginal configuration.

9. The display sign system of claim 4 in which said sign units abut at their sides in substantially vertical lines of abutment and said plate means have peripheral edges that intersect said vertical lines of abutment.

10. The display sign system of claim 4 in which each of said top bracket means include a plurality of plate members with each such member joining together two abutting sign units.

11. A display sign system for displaying indicia, the system comprising: three vertically oriented sign units each having a pair of opposite vertical display faces that receive said indicia and margins defined by a pair of flat vertical side marginal portions, a top marginal portion and a bottom marginal portion, the sign units being arranged adjacent one another and projecting outwardly from a common center with the edges of their flat side marginal portions in confronting contiguous relation at said center to form triangular openings at the center and a plural legged open structure presenting both vertical faces of each sign unit for viewing; and top bracket means and bottom bracket means for joining said plurality of sign units together at their respective top and bottom marginal portions, the top and bottom bracket means each including a plate having a plurality of legs respectively extending horizontally along the associated top or bottom marginal portion of one of the sign units, each of said plates including a vertical stabilizing shaft in said triangular opening and projecting between the confronting marginal portions of the sign units at the center of the display sides disposed centrally thereof, said shaft having flat faces abutting the flat confronting side marginal portions of said sign units.

12. The display sign system of claim 11 including at least one glide engaged under each leg of the plate of the bottom bracket means and adapted to contact a floor to stabilize and balance said system.

13. A multiple configuration display sign system for displaying indicia, the system comprising: a plurality of vertically oriented sign units each having a pair of opposite vertical faces at least one of which receives said indicia and margins defined by a pair of vertical side marginal portions, a top marginal portion and a bottom marginal portion, the sign units being vertically arranged adjacent one another with both of their side marginal portions in confronting continguous relation with adjacent sign units to form a closed structure enclosing a space therein; and top bracket means and bottom bracket means for joining said plurality of sign units together at their respective top and bottom marginal portions, the top and bottom bracket means each including a plate having a peripheral configuration substantially coinciding with the configuration of the top and bottom marginal portions of said sign units in said closed configuration, and the plates closing off the ends of said enclosed space.

14. The display sign system of claim 13 in which said sign units abut at substantially vertical lines of abutment and each of said plates have peripheral edges that intersect said vertical lines of abutment.

15. The display sign system of claim 13 including a plurality of glides engaged under the bottom bracket means and adapted to contact a floor to stabilize and balance said system.

16. The display sign system of claim 13 in which there are three sign units and the configuration of the plates is triangular.

17. The display sign system of claim 13 in which there are four sign units and the configuration of the plates is square.

18. The display sign system of claim 13 in which there are five sign units and the configuration of the plates in pentagonal.

19. A display sign system for displaying indicia, the system comprising: three vertically oriented sign units forming a closed structure, each sign unit having a pair of opposite vertical faces at least one of which receives said indicia and margins defined by a pair of vertical side marginal portions, a top marginal portion and a bottom marginal portion, the sign units being vertically arranged adjacent one another both vertical sign marginal portions of each sign unit confronting the side marginal portions of another sign unit; and top bracket means and bottom bracket means for joining said plurality of sign units together at their respective top and bottom marginal portions, the top and bottom bracket means each including a plate, and each of said plates being of triangular configuration where the margins thereof follow the adjacent top or bottom marginal portions of the associated sign units.

20. A display sign system for displaying indicia, the system comprising: four sign units forming a closed structure, each sign unit having a pair of opposite vertical faces at least one of which receives said indicia and margins defined by a pair of vertical side marginal portions, a top marginal portion and a bottom marginal portion, the sign units being vertically arranged adjacent one another where both vertical side marginal portions of each sign unit confront the side marginal portions of another sign unit; and top bracket means and bottom bracket means for joining said plurality of sign units together at their respective top and bottom marginal portions, the top and bottom bracket means each including a plate, and each of said plates being of square configuration.

21. A display sign system for displaying indicia, the system comprising: five sign units forming a closed structure, each sign unit having a pair of opposite vertical faces at least one of which receives said indicia and margins defined by a pair of vertical side marginal portions, a top marginal portion and a bottom marginal portion, the sign units being vertically arranged adjacent one another; and top bracket means and bottom bracket means for joining said plurality of sign units together at their respective top and bottom marginal portions, the top and bottom bracket means each including a plate, and each of said plates being of pentagonal configuration.

22. A display sign system for displaying carried indicia, the system comprising: five vertically oriented sign units each having a pair of opposite vertical display faces that receive said indicia and margins defined by a pair of vertical side marginal portions, a top marginal portion and a bottom marginal portion, the sign units being arranged adjacent one another with at least one vertical side marginal portion of each sign unit in confronting contiguous relation to that of another sign unit; and top bracket means for joining said plurality of sign units together at their top and bottom marginal portions, said top bracket means including five separate plates each joining together at least two adjacent sign units.

23. A display sign system for displaying indicia, the system comprising at least one vertically oriented sign unit having a pair of opposite vertical faces at least one of which receives said indicia and margins defined by a pair of side marginal portions, a top marginal portion, and a bottom marginal portion, a channel member having a leg depending from said top marginal portion thereof, said leg being spaced from said one vertical face thereof to form a downwardly opening slot below said top marginal portion adjacent one vertical face thereof, and said leg having a lower surface, and bracket means adapted to be anchored to a vertical structure for carrying said sign unit, said bracket means including an upper angle bracket having an upstanding flange that is engaged in said slot to retain said sign unit on said bracket means, and said upper angle bracket having a horizontal surface extending to the base of said upstanding flange and said lower surface of said sign unit leg resting upon and being carried by said bracket horizontal surface.

24. A display sign system for displaying indicia, the system comprising at least one vertically oriented sign unit having a pair of opposite vertical faces at least one of which receives said indicia and margins defined by a pair of side marginal portions, a top marginal portion and a bottom marginal portion, said sign unit further having at least one downwardly opening slot below said top marginal portion adjacent one vertical face thereof; and bracket means adapted to be anchored to a vertical structure for carrying said sign unit, said bracket means including an upper angle bracket having an upstanding flange that is engaged in said slot to retain said sign unit on said bracket means and said bracket means including a lower bracket means for restraining rotation of said sign unit around said upper bracket.

25. A display sign system for displaying indicia, the system comprising at least one vertically oriented sign unit having a pair of opposite vertical faces at least one of which receives said indicia and margins defined by a pair of side marginal portions, a top marginal portion and a bottom marginal portion, means forming a downwardly opening slot below said top marginal portion adjacent one vertical face thereof, and bracket means adapted to be anchored to a vertical structure for carrying said sign unit, said bracket means including an upper angle bracket having an upstanding flange that is engaged in said slot to retain said sign unit on said bracket means, and said bracket means include a lower bracket ferromagnetically fixed to said sign unit.

26. A display sign system for displaying indicia, the system comprising a plurality of sign units vertically arranged with their side margins in confronting contiguous relation, the sign units being at selected angles to one another, each of said sign units having a pair of opposite vertical faces at least one of which receives said indicia and margins defined by a pair of side marginal portions, a top marginal portion, and a bottom marginal portion, means forming a downwardly opening slot below said top marginal portion adjacent one vertical face thereof, and bracket means adapted to be anchored to a vertical structure for carrying said sign unit, said bracket means including an upper angle bracket having an upstanding flange that is engaged in said slot to retain said sign unit on said bracket means.

* * * * *